US006863525B2

(12) United States Patent
Byrd

(10) Patent No.: US 6,863,525 B2
(45) Date of Patent: Mar. 8, 2005

(54) SAFETY CANDLE AND METHOD OF FORMING SAME

(76) Inventor: Ralph Dwayne Byrd, 135 Eldridge La., State Road, NC (US) 28676

( * ) Notice: Subject to any disclaimer, the term of this patent is extended or adjusted under 35 U.S.C. 154(b) by 0 days.

(21) Appl. No.: 10/459,960

(22) Filed: Jun. 12, 2003

(65) Prior Publication Data

US 2004/0048213 A1 Mar. 11, 2004

Related U.S. Application Data

(60) Provisional application No. 60/409,086, filed on Sep. 9, 2002.

(51) Int. Cl.[7] ..... F24C 13/00
(52) U.S. Cl. ..... 431/35; 431/289
(58) Field of Search ..... 431/35 O, 289

(56) References Cited

U.S. PATENT DOCUMENTS

| | | | | |
|---|---|---|---|---|
| 664,246 A | | 12/1900 | Ellis | |
| 1,660,760 A | | 2/1928 | Murphy | |
| 1,867,420 A | | 7/1932 | Root | |
| 2,481,019 A | * | 9/1949 | Joyce | 431/126 |
| 3,036,452 A | | 5/1962 | Renwick, Sr. et al. | |
| 3,183,688 A | | 5/1965 | Sobelson | |
| 3,236,072 A | | 2/1966 | Goldszmid | |
| 3,286,492 A | | 11/1966 | Frazier, Jr. | |
| 3,516,774 A | | 6/1970 | Livingstone | |
| 3,744,957 A | | 7/1973 | Wright, Sr. | |
| 3,797,990 A | | 3/1974 | Rogers et al. | |
| 3,873,263 A | | 3/1975 | DeCroix | |
| 3,910,753 A | | 10/1975 | Lee | |
| 3,998,922 A | * | 12/1976 | Weiss | 264/255 |
| 4,013,397 A | | 3/1977 | Neugart | |
| 4,332,548 A | * | 6/1982 | Linton et al. | 431/289 |
| 4,494,926 A | | 1/1985 | Riha | |
| 4,878,832 A | | 11/1989 | Lynch | |
| 5,193,994 A | | 3/1993 | Schirneker | |
| 5,690,484 A | | 11/1997 | Leonard et al. | |
| 5,842,850 A | * | 12/1998 | Pappas | 431/291 |
| 5,961,318 A | * | 10/1999 | Chambers et al. | 431/320 |
| 6,062,847 A | | 5/2000 | Pappas | |
| 6,398,544 B2 | * | 6/2002 | Wright et al. | 431/291 |
| 6,454,561 B1 | | 9/2002 | Colthar et al. | |
| 6,508,644 B1 | | 1/2003 | Pesu et al. | |
| 6,604,940 B2 | * | 8/2003 | Pappas | 431/298 |
| 6,648,631 B2 | * | 11/2003 | Wright et al. | 431/291 |

FOREIGN PATENT DOCUMENTS

DE 36 30 712 A1 3/1988

* cited by examiner

*Primary Examiner*—Alfred Basichas
(74) *Attorney, Agent, or Firm*—Alston & Bird LLP

(57) ABSTRACT

A safety candle and a method of forming the same which includes a coaxial wick having its lower end portion fixedly secured in an injection molded, thermoplastic wick support. The wick support may incorporate a flame retardant which can be mixed with the thermoplastic material of the support to aid in snuffing the flame. The wick support is preferably formed of a high melt polypropylene or a clear polycarbonate.

15 Claims, 2 Drawing Sheets

SAFETY CANDLE AND METHOD OF FORMING SAME

CROSS-REFERENCE TO RELATED APPLICATIONS

This application claims the benefit of U.S. Provisional Application No. 60/409,086, filed Sep. 9, 2002.

FIELD OF THE INVENTION

The present invention relates to candles and more particularly to safety candles and a method of forming same.

BACKGROUND OF THE INVENTION

It is conventional to form candles with a centrally positioned wick around which a fuel, such as wax, is poured and solidifies. The lower end portion of the wick is often attached to a wick support, base or sustainer. Typically, such a wick support is a metal disk with a central hole punched therein into which the lower end of the wick is inserted and the wick support is crimped around the wick. When the wax is poured around the wick, the wick support is embedded in the solidified wax.

A distinct disadvantage of such wicks and wick supports is commonly referred to as "flare-up" or "flash-over". This phenomenon occurs when the candle burns down to the wick support and molten wax is drawn upwardly through the central bore of the wick support and there is a flare-up or flash-over.

Several attempts have been proposed to solve this problem. One such attempt is disclosed in U.S. Pat. No. 3,797,990, issued to Avon Products on Mar. 19, 1974. This patent discloses the use of a safety wax, which is non-flammable at the temperature generated as the candle burns, below or on top of the wick support. In one embodiment, this patent discloses that a polyamide may be used instead of the safety wax. While such safety wax will generally prevent flare-up or flash-over, it is usable only in container-type candles and not self-supporting type candles and is difficult and expensive to manufacture.

Another such attempt is disclosed in U.S. Pat. No. 6,062,847, in which a metal or ceramic wick support in a container candle is at least one-half to one inch above the lowest level of the fuel or wax to prevent flash-over. Also, the bore through the wick support is closed by adhesive or the like.

While somewhat successful in preventing flash-over or flare-up, the attempts as described above are generally limited to container candles and rely solely upon fuel deprivation for extinguishing the flame. Also, such attempts require special containers or additional elements which increase the cost of the candles.

A further prior attempt to eliminate "flare-up" or "flash-over" is illustrated by the prior candle construction shown in FIGS. 5 and 6 of the present application. In this construction, a circular metal base plate 14 is joined to the end of the candle wick 12 by crimping the periphery of an aperture in the plate about the wick. Thereafter, an annular plastic button 15 is threaded onto the wick so as to rest upon the bottom plate, and a melted combustible wax 18 is then molded about the wick to complete the fabrication of the candle. The plastic button 15 was composed of a mixture of a plastic, such as polypropylene, and a flame retardant, such as the brominated, hydrogenated flame retardant sold by PolyOne Distribution Company of Statesville, N.C. under the product designation PP Conc 36 Nat S. Thus in use, when the flame burns down to the area of the button, the flame retardant is released by the heat of the flame, and the flame is extinguished.

While the candle as shown in FIGS. 5 and 6, and as described above, represents a significant improvement, it is not entirely satisfactory since the assembly of the button onto the wick is a time consuming operation which is usually conducted by hand, and the loose fitting of the button on the wick can result in mis-alignment of the button during the molding of the wax to embed the wick. Thus, further improvement is desirable.

SUMMARY OF THE INVENTION

With the foregoing in mind, it is an object of the present invention to provide a candle having a wick support with flame snuffer capabilities and method of forming the same, which alleviates the disadvantages of the prior constructions as noted above. This object is accomplished by providing a plastic wick support, which in a first embodiment is directly molded around the lower end of the wick, and with the support being composed of a thermoplastic polymeric material having a high melt temperature. Also, the polymeric material preferably has incorporated therein a flame retardant that is released when the wick support is heated by the flame to a predetermined temperature below the melt temperature of the polymeric material.

In another embodiment, the plastic support is independently molded so as to include a bore which receives the lower end portion of the wick, and wherein the support is crimped onto the lower end portion of the wick to fixedly secure the lower end portion in the bore.

BRIEF DESCRIPTION OF THE DRAWINGS

Figure 1:
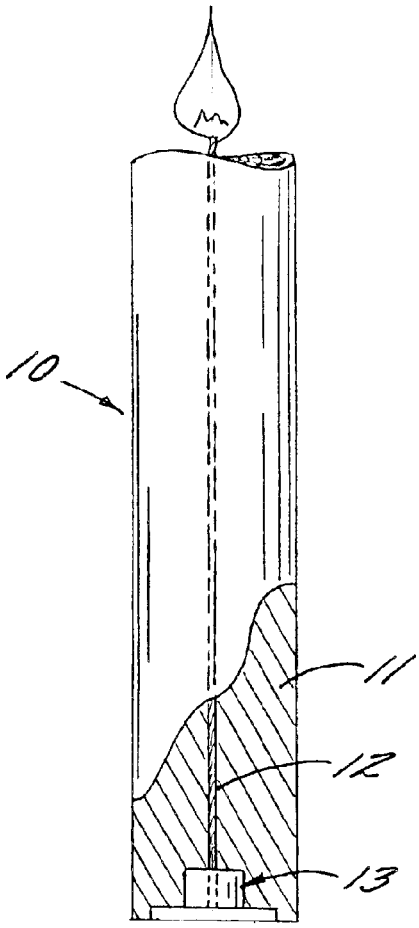
Figure 2:
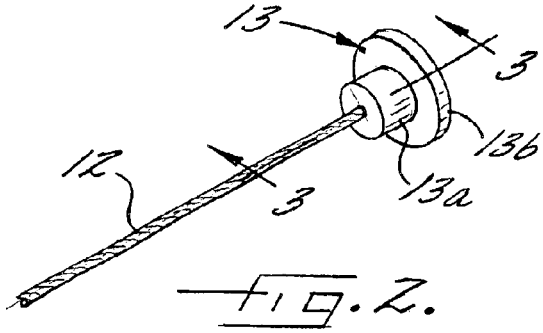
Figure 3:
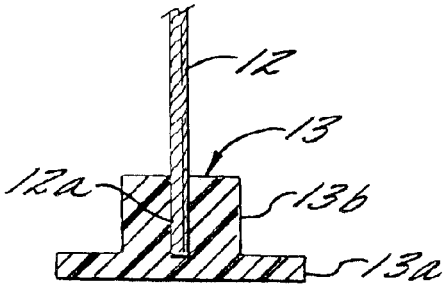
Figure 4A:
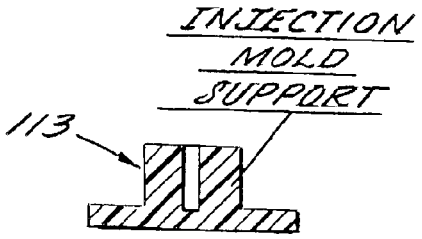
Figure 4B:
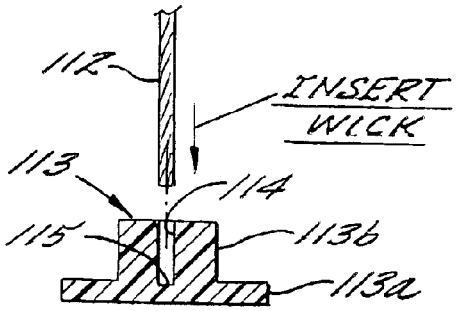
Figure 4C:
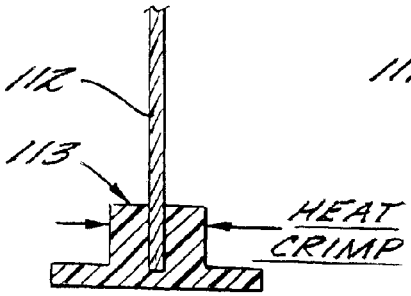
Figure 4D:
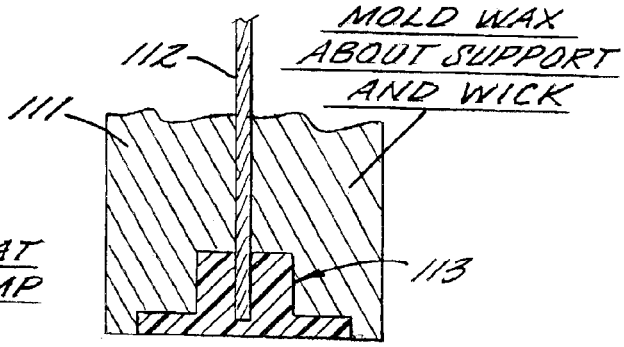
Figure 5:
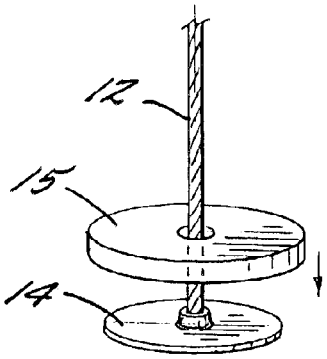
Fig. 5. (PRIOR ART)
Figure 6:
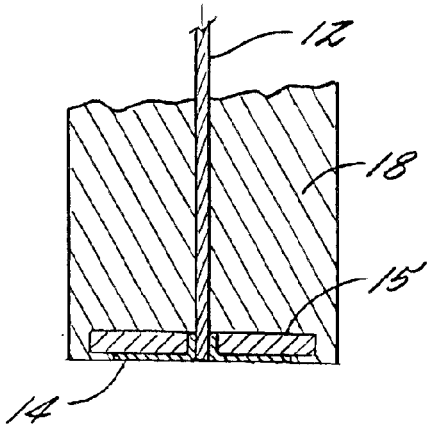
Fig. 6. (PRIOR ART)

Having thus described the invention in general terms, reference will now be made to the accompanying drawings, which are not necessarily drawn to scale, and wherein:

FIG. 1 is an elevational view, with a portion broken away, of a candle incorporating the wick support of the present invention;

FIG. 2 is a perspective view of a wick and wick support of the present invention;

FIG. 3 is an enlarged, fragmentary sectional view taken substantially along line 3—3 in FIG. 2;

FIGS. 4A–4D are in the nature of a flow diagram which illustrates the steps in the manufacture of the candle in accordance with the embodiment wherein the support is heat crimped onto the wick; and FIGS. 5 and 6 are perspective and cross sectional views, respectively, illustrating a prior construction of a safety candle as discussed above.

DETAILED DESCRIPTION OF THE PREFERRED EMBODIMENTS

The present invention now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now more particularly to FIGS. 1–3 of the drawings, there is shown a candle, generally indicated at 10, including an elongate body 11 of fuel, such as a conventional flammable wax. An elongate wick 12 which typically consists of a cotton or paper string coated with a wax, is disposed within, and coaxial with, the elongate body 11. The lower end portion 12*a* of the wick 12 is embedded in a wick support 13.

Wick support 13 includes a base portion 13*a* and a cylindrical pedestal portion 13*b* which is integrally formed with the base portion 13*a*. Wick support 13 is formed of a thermoplastic polymeric material having a melt temperature higher than the temperature generated by the flame burning the wick 12 and fuel forming the elongate body 11. Specifically, the wick support 13 may be formed of polypropylene, such as, for example, Product P4G4Z-011 by PolyOne Distribution Company of Statesville, N.C., and which has a melting point between about 160–166° C. A second suitable plastic for the support 13 is Dowlex® 2535 polyethylene resin manufactured by the Dow Chemical Company. Forming the support 13 of a clear polycarbonate, such as Lexan® manufactured by GE, or Iupilon® manufactured by Mitsubishi Engineering-Plastics Corp. is also possible and desirable since it permits the mixing of varying colorants with the polymer. The indicated polycarbonates have a melting temperature of about 120° C.

In accordance with one embodiment of the present invention, and as illustrated in FIGS. 1–3, wick support 13 is formed by injection molding in which the polymeric material is melted and injected into a mold (not shown) having at least one cavity, usually a plurality of cavities, of the proper shape and size therein in a manner well known to those skilled in the injection molding art. Preferably, the injection mold has a port into each cavity therein. A wick 12 is inserted through each of these ports into the associated cavity so that each wick support 13 will be molded with the inner, i.e. lower, end portion 12*a* of the wick 12 embedded in the pedestal portion 13*b* of the wick support 13. Preferably, the wick 12 is located in the mold so that the lower end portion 12*a* is totally enclosed by the polymeric material which forms the support 13, i.e. the lower end of the wick is covered and not exposed below the base portion 13*a*. In this manner, the wick 12 is firmly and securely attached to the wick support 13 and may be separated therefrom only with considerable difficulty.

Preferably, a flame retardant is mixed into the polymeric material in an extruder prior to the injection molding thereof to form each wick support 13. While a variety of conventional halogen based flame retardants may be used, note for example the flame retardants disclosed in U.S. Pat. No. 6,518,344 which is incorporated by reference, it is preferred that a liquid concentrate of a brominated, hydrogenated flame retardant, be used, such as for example, PP Conc 36 Nat S by PolyOne Distribution Company of Statesville, N.C. A further example of a suitable flame is textra-bromobisphenore-a-polycarbonate-oligomer, also sold by PolyOne.

As a non-limiting specific example, the wick support has a base portion 13*a* having a diameter of about 0.75 inches and a thickness of about 0.08 inches. The cylindrical pedestal portion has a height of about 0.20 inches and a diameter of about 0.32 inches. It is preferred that each of the indicated dimensions be at least 0.08 inches to avoid loss of the flame retardant capability. Also, the wick support can be formed of a mixture of a polycarbonate resin and halogen based flame retardant in a weight ratio of between about 10% to about 30% flame retardant to resin. In the case of the above oligomer flame retardant, the flame retardant is preferably employed in a ratio of about 15% by weight.

In use, the wick support 13 will deprive the wick 12 of fuel once the fuel level burns down below the top of the pedestal portion 13*b* of the wick support 13 since the wick 12 does not extend completely through the wick support 13. Additionally, the polymeric material of which wick support 13 is formed will not melt at the temperature generated by the flame nor will it conduct sufficient heat to cause the fuel to be ignited once the fuel burns down below the top of the pedestal portion 13*b*. Finally, the flame retardant incorporated in the wick support 13 will be liberated when the flame burns down to a level proximate the wick support 13 and will assist in snuffing the flame.

A second embodiment of the prevent invention, and its method of manufacture are illustrated in FIGS. 4A–4D. In this embodiment, the wick support 113 is separately molded in a conventional injection molding machine, and the support includes a base or flange portion 113*a* and a cylindrical pedestal portion 113*b* of unitary one piece construction. Also, the support is molded so as to include a coaxial bore 114 which extends thereinto from the upper end. The bore 114 has a length which extends substantially the full length of the pedestal portion, and it includes a closed end 115. Alternatively, the bore could be formed by a drilling operation.

As illustrated in FIG. 4B, the lower end portion of a wick 112 is inserted coaxially into the bore of the support, with the end of the wick preferably abutting the closed end 115 of the bore 114.

Next, and as illustrated in FIG. 4C, the pedestal portion is crimped laterally so as to fixedly secure the wick 112 in the bore. Preferably, this crimping operation is accompanied by the application of heat to soften the pedestal and facilitate its movement against the wick. As an alternative to the crimping step, the wick could be anchored in the bore with an adhesive.

Finally, and as illustrated in FIG. 4D, the candle wax 111 is molded about the wick 112 and the support 113 to form the finished candle. Typically, the wick and support are positioned in the finished candle so that the upper end of the pedestal portion 113*b* is not significantly more than about ¼ inch above the base of the candle.

The process as illustrated in FIGS. 4A–4D can be performed by hand using hand tools. However, it is preferred to automate the process wherein the wick material is withdrawn from a supply spool and delivered to an assembly station. The molded supports are fed serially to the assembly station from a feeder bowl, and at the assembly station, a repeating sequence of steps is performed, which includes 1. pulling a support which has had the leading end of the wick assembled thereto, away from the assembly station,
2. pushing the trailing wick into the bore of the next successive support at the assembly station, so as to cause the wick to double-up into a U-shape in the bore, while simultaneously or immediately thereafter cutting the wick so as to free the previous support and assembled wick segment which is then released,
3. moving a traveling crimp arm over the newly assembled support to heat crimp the support about the wick,
4. withdrawing the crimp arm to pull away the support and assembled wick as in step 1, and then
5. repeating the above cycle.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A safety candle characterized by the ability to extinguish a flame of the candle when the candle is essentially completely consumed, comprising an elongate candle wick having an upper end portion and a lower end portion, a molded wick support having the lower end portion of the wick fixedly secured therein, with said wick support comprising a polymeric material having a melt temperature higher than the temperature generated by the flame of the candle, a body composed of a combustible material which is solid at room temperature and liquid when heated by the flame of the candle, said body defining opposite ends and coaxially surrounding said wick so as to embed substantially the full length of the wick and the support within the body, with the support being located adjacent one end of the body, and with the upper end portion of the wick extending outwardly from the other end of the body, and wherein said wick support further comprises a flame retardant which is mixed with the polymeric material and is released from the polymeric material when the wick support is heated by the flame of the candle.

2. The safety candle of claim 1 wherein said wick support is integrally molded and includes a lower flange portion and a cylindrical pedestal portion extending from the flange portion in a direction toward the other end of the body.

3. The safety candle of claim 2 wherein said wick extends coaxially into said pedestal portion of said support a distance at least substantially equal to the height of the pedestal portion.

4. The safety candle of claim 1 wherein the wick support is integrally molded about the lower end portion of the wick and so as to fixedly embed the lower end portion of the wick in the support.

5. The safety candle of claim 1 wherein the wick support includes a bore which receives the lower end portion of the wick, and wherein the wick support is crimped onto the lower end portion of the wick to fixedly secure the lower end portion of the wick in said bore.

6. The safety candle of claim 1 wherein the polymeric material of the wick support comprises a clear thermoplastic polycarbonate having a colorant mixed therewith.

7. The method of claim 1 wherein said wick support is configured so as to totally embed the lower end portion of the wick therein.

8. The method of claim 7 wherein said wick support is integrally molded and includes a lower flange portion and a cylindrical pedestal portion extending from the flange portion in a direction toward the other end of the body.

9. A safety candle characterized by the ability to extinguish a flame of the candle when the candle is essentially completely consumed, comprising an elongate candle wick having an upper end portion and a lower end portion, a molded wick support comprising a polymeric material having a melt temperature higher than the temperature generated by the flame of the candle, said wick support being configured to define a cylindrical pedestal portion, with said wick being disposed in a bore which extends coaxially and at least substantially through said pedestal portion, and with said pedestal portion being crimped into engagement with said wick to maintain the assembly of the wick and the support, a body composed of a combustible material which is solid at room temperature and liquid when heated by the flame of the candle, said body defining opposite ends and coaxially surrounding said wick so as to embed substantially the full length of the wick and the support within the body, with the support being located adjacent one end of the body, and with the upper end portion of the wick extending outwardly from the other end of the body, and wherein said wick support further comprises a flame retardant which is mixed with the polymeric material and is released from the polymeric material when the wick support is heated by the flame of the candle.

10. The safety candle of claim 9 wherein said bore does not extend completely through said support so that the lower end portion of the wick is totally enclosed therein.

11. A method of making a safety candle characterized by the ability to extinguish a flame of the candle when the candle is essentially completely consumed, comprising the steps of providing an elongate candle wick having an upper end portion and a lower end portion, molding a wick support onto the lower end portion of the wick, with said wick support comprising a polymeric material having a melt temperature higher than the temperature generated by the flame of the candle, and forming a body composed of a combustible material which is solid at room temperature and liquid when heated by the flame of the candle, with said body defining opposite ends and coaxially surrounding said wick so as to embed substantially the full length of the wick and the support within the body, with the support being located adjacent one end of the body, and with the upper end portion of the wick extending outwardly from the other end of the body, and wherein said wick support further comprises a flame retardant which is mixed with the polymeric material and is released from the polymer when the wick support is heated by the flame of the candle.

12. A method of making a safety candle characterized by the ability to extinguish a flame of the candle when the candle is essentially completely consumed, comprising the steps of providing an elongate candle wick having an upper end portion and a lower end portion, molding a wick support which is configured to have a cylindrical pedestal portion with a coaxial bore extending thereinto from one end thereof, and with said wick support comprising a polymeric material having a melt temperature higher than the temperature generated by the flame of the candle, inserting the lower end portion of the wick coaxially into the bore of the pedestal portion of the support, crimping the pedestal portion of the support to fixedly secure the lower end portion of the wick in said bore, and forming a body composed of a combustible material which is solid at room temperature and liquid when heated by the flame of the candle, with said body defining opposite ends and coaxially surrounding said wick so as to embed substantially the full length of the wick and the support within the body, with the support being located adjacent one end of the body, and with the upper end portion of the wick extending outwardly from the other end of the body, and wherein said wick support further comprises a flame retardant which is mixed with the polymeric material and is released from the polymeric material when the wick support is heated by the flame of the candle.

13. The method of claim 6, wherein said wick support includes a lower flange portion which is integrally molded with the pedestal portion, with the pedestal portion extending from the flange portion in a direction toward the other end of the body.

14. The method of claim 6 wherein said bore defines a closed end in said support.

15. The method of claim 6 wherein the crimping step includes the application of heat sufficient to soften the pedestal portion.

* * * * *